US005092707A

United States Patent [19]

Obermeyer

[11] Patent Number: 5,092,707

[45] Date of Patent: Mar. 3, 1992

[54] CREST GATE OPERATING SYSTEM

[76] Inventor: Henry K. Obermeyer, P.O. Box 668, Fort Collins, Colo. 80522

[21] Appl. No.: 603,655

[22] Filed: Oct. 25, 1990

[51] Int. Cl.[5] ..... E02B 7/20

[52] U.S. Cl. ..... 405/92; 137/386; 405/91; 405/115

[58] Field of Search ..... 405/115, 114, 92, 91, 405/100, 101, 102, 107, 108; 137/386, 392

[56] References Cited

U.S. PATENT DOCUMENTS

| | | | |
|---|---|---|---|
| 3,338,261 | 8/1967 | Bergeson et al. | 437/386 |
| 3,922,564 | 11/1975 | Kachuk et al. | 137/392 |
| 4,332,507 | 6/1982 | Wakamori et al. | 405/92 |
| 4,498,809 | 2/1985 | Farmer | 405/92 |
| 4,772,157 | 9/1988 | Obermeyer | 405/92 X |
| 4,780,024 | 10/1988 | Obermeyer et al. | 405/115 |

FOREIGN PATENT DOCUMENTS

| | | | |
|---|---|---|---|
| 2460366 | 2/1981 | France | 405/92 |
| 0012410 | 2/1981 | Japan | 405/92 |

*Primary Examiner*—Dennis L. Taylor
*Attorney, Agent, or Firm*—McCormick, Paulding & Huber

[57] ABSTRACT

Several panels are pivotably mounted on top of a dam spillway for movement by air pressure provided through bladders downstream of these panels. The bladders are made from an elastomeric sheet that is folded so that edge portions overlap one another. A clamping bar secures these overlapping portions to the dam spillway. The sheet is also secured to the panel and defines the pivot or hinge joint for the panel. Abutments or stops on the clamping bar engage a strap, that also secures the bladder to the panel, so that the panel will not move upwardly beyond a limit position. An air operating system is disclosed for moving the panels in response to changes in the height or head of water upstream of the panels.

20 Claims, 4 Drawing Sheets

CREST GATE OPERATING SYSTEM

This invention relates generally to crest gates for dam spillways, and deals more particularly with a system for operating one or more crest gates arranged longitudinally of a dam spillway.

BACKGROUND OF THE INVENTION

Inflatable bladders provided on the downstream side of a pivoted panel are known as a preferred approach to providing a crest gate at a dam spillway to control the height of the water behind the crest gate. U.S. Pat. No. 4,780,024 issued to the inventor herein Oct. 25, 1988 and illustrates one form of such a crest gate construction, the bladder being inflatable from a source of pressure to maintain a predetermined water level behind the dam.

SUMMARY OF THE INVENTION

In accordance with the present invention at least one generally rectangular rigid gate panel is provided with parallel and horizontal first and second marginal edges. Means for pivotally supporting each panel's movement on the lower marginal edge thereof is provided at the crest of the dam spillway. One or more inflatable bladders are provided downstream of the panel or panels and between the dam spillway and the panels. The inflatable bladder is secured to the panel supporting means, and in accordance with the present invention means is provided for selectively inflating or deflating the bladder. Said means preferably includes a source of air under pressure, inflation and deflation lines, control valve means for selectively connecting these inflation and deflation lines to the bladder, and means is also provided for venting air at low pressure at a predetermined point in the water upstream of the panel such that the hack pressure exerted on the low pressure air by the water itself will vary in proportion to the water's depth at this pre-determined point. Transducer means is provided for operating the control valve means in response to these air pressure changes.

The bladder itself preferably comprises an elongated elastomeric sheet having one and another marginal edge portions laid one above the other, providing a sealed joint longitudinally of these overlapping marginal edge portions. The bladder is generally tubular and integrally formed end portions include overlapped segments that are sealed to one another. The means for securing the bladder in position preferably comprises a clamping bar overlying the overlapped marginal edge portions, and bolts secure the clamping bar to the dam spillway.

The longitudinally extending marginal edge portions of the elastomeric bladder have at least one of their number folded back on top of the other with a free flap segment extending beyond the joint itself. An elongated metal strap is provided to secure this flap segment to the panel with the result that the elastomeric sheet also defines the hinge joint for the panel. This strap is bolted to the panel with the flap portion of the elastomeric sheet therebetween and is arranged parallel to the clamping bar but spaced slightly from it. Longitudinally spaced stops are provided on the clamping bar for engaging the strap or gate panel when the panel is pivoted upwardly to a predetermined limit position.

Finally, it is a feature of the present invention that the inflation and deflation lines, the control valve means, and the air pressure source are all located remotely from the dam spillway itself. The bladder air line extends along a trench provided for this purpose in the dam spillway. One way check valves are provided to assure operation of the system, and pressure retained in the bladders following loss of compressed air at any individual blader or bladders, will provide sufficient energy to maintain sufficient pressure to avoid sudden lowering of the panels.

DETAILED DESCRIPTION

Turning now to the drawings in greater detail, a crest gate constructed in accordance with the present invention may be of the type illustrated in my prior U.S. Pat. No. 4,780,024, or may instead comprise a crest gate of the type shown in PCT application Ser. No. US88/03764 filed Oct. 25, 1988.

As described in the PCT application a generally horizontally extending upper surface of the dam spillway extends generally longitudinally between raised abutments on either side of the spillway in accordance with conventional practice.

Figure 2:
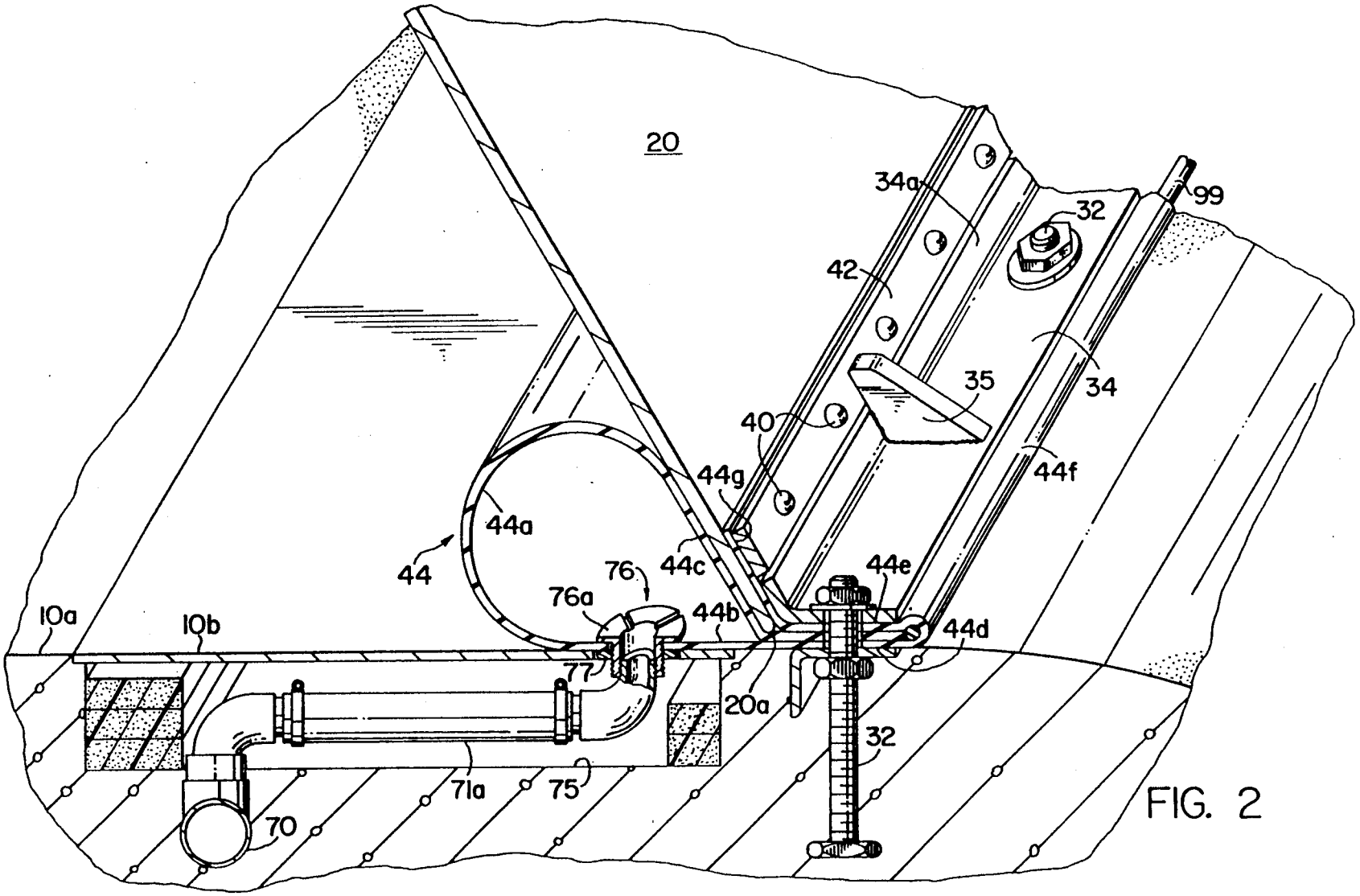
FIG. 2 is a vertical sectional view taken generally through a panel provided in the raised or up position by an inflated bladder.

At least one and preferably more than one generally rectangular rigid panels 20, 20 extend longitudinally across the spillway so as to hold back water behind the dam structure and behind the panels. Each panel includes a first marginal edge 20*a* and a second marginal edge (not shown) provided in parallel horizontal relationship to the first edge and forming the upper end of the crest gate panel when the panel is in its raised position as shown in FIG. 2.

Means is provided for pivotally supporting the panel for movement about a horizontally extending axis located generally coincidentally with the first marginal edge 20*a* of the panel. Preferably said means comprises a sheet of elastomeric material having one and another marginal edge portions laid one on top of the other as suggested in the above-identified PCT application. These marginal edge portions are clamped to provide a sealed joint therebetween. As shown, the elastomeric sheet 44 is formed into a bladder by a process to be described, and includes a generally semi-circular portion 44*a*. Generally flat marginal edge portions 44*d* and 44*e* lie in contact with the concrete spillway surface. A cover 10*b* is provided over a shallow trench that serves as a continuation of this concrete spillway surface 10*a* and the bladder portion 44*b* overlies this cover. Bladder portion 44*c* abuts the panel 20.

The marginal edge portions 44*d* and 44*e* are laid up so that the latter is provided on top of the former in order to provide for a sealed joint for the inflatable bladder 44 along the bladder's length.

A clamping bar 34 of steel is provided on top of these marginal edge portions of the elastomeric sheet and is secured in position on the dam spillway by anchor bolts (as suggested generally at 32).

In order to prevent the bladder 44 from slipping out of position between the top 10*a* of the concrete spillway and the underside of the clamping bar 34 a portion 44*f* of the elastomeric sheet is wrapped around a elongated cylindrical element such as the cord 99. This geometry increases the cross sectional size and configuration of the elastomeric sheet at an upstream portion of the overlapping marginal edge portions to prevent inadvertent pulling of the elastomeric sheet, and the bladder defined thereby in the downstream direction as a result of the force or head of the water behind the panel 20. The element 99 is preferably made from an incompressible material such as a high durometer elastomer.

The elastomeric sheet 44 further includes a flap portion 44*g* that is not secured under the clamping bar but which forms an extension to that portion of the elastomeric sheet so secured under the clamping bar. Thus, the flap portion 44*g* is integrally connected to the portion 44*f* of the sheet wrapped around the cord 99 and thence integrally connected to the portion 44*d* lying adjacent the concrete spillway.

The clamping bar 34 has an upturned marginal edge portion 34*a* and the free end or flap portion 44*g* of the elastomeric sheet extends beyond this upturned edge to provide a hinge joint between the panel 20 and the clamping bar and bladder configuration.

More particularly, the panel 20 is secured to this free end or flap portion 44*g* by screws 40 and by a metal strap 42 which serves to provide rigidity to the free end portion of the flap 44*g*, and to assist in securing the panel 20 to the elastomeric sheet flap portion 44*g*.

As so constructed and arranged the above described crest gate configuration obviates the need for a conventional hinge joint in the hostile environment of a dam spillway. Furthermore, such a configuration also serves to define a very economically shaped bladder configuration, the elastomeric sheet not only serving to define the bladder but also serving to define the pivoting means for the panel.

Upwardly open troughs are preferably provided at the longitudinally opposed ends of a crest gate configuration and these troughs are preferably vented to atmosphere so as to avoid negative pressures behind the panel as a result of water spilling over the upper edge portion thereof. This aspect of the disclosure can be gleaned from my copending PCT application referred to previously.

As mentioned previously at least one and preferably three generally rectangular panels 20, 20 are provided across the longitudinal length of the spillway and each panel may include its own inflatable bladder or several panels may be raised by a single bladder or vice versa several bladders may be provided to raise a single panel. In this case, adjacent panels may have an overlapping edge to provide means for closing any opening between adjacent panels. These overlapping edges may comprise flexible elastomeric components that provide a degree of resiliency so as to afford relative movement between the adjacent panels without the panels unduly interfering one with another across the dam spillway.

Figure 1:
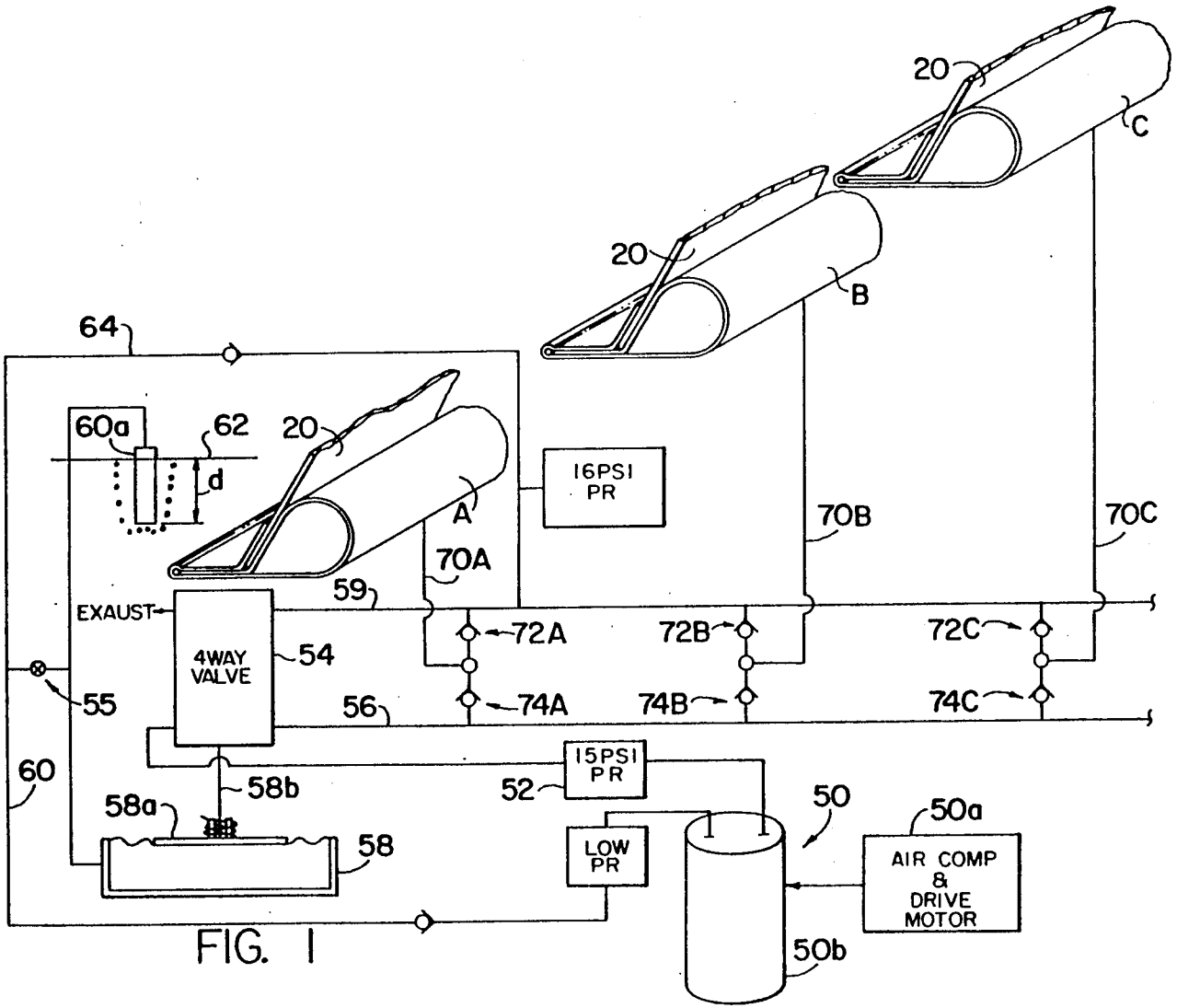
FIG. 1 is a schematic view illustrating the various components of a crest gate operating system.

Turning now to a detailed description of the system for operating a plurality of bladders provided across a typical dam spillway FIG. 1 illustrates three bladders A. B and C. These bladders are arranged in end-to-end relationship and each bladder has an associated rigid panel 20 such as that described previously with reference to FIG. 2. Means is provided for inflating and deflating these bladders, and said means include a source of air under pressure as indicated generally at 50 in the lower right portion of FIG. 1. This air pressure source comprises a conventional air compressor driven by a suitable drive motor as indicated schematically at 50*a*, and an air pressure tank 50*b* which stores the pressurized air, at 50 psi to 150 psi, in response to a conventional air pressure control (not shown). Pressurized air is provided through a 15 pound per square inch pressure regulator 52 to a four way valve 54. While a four way valve is shown two three way valves might also be adapted for accomplishing the necessary inflation and deflation of the bladders A, B, and C. The four way valve 54 comprises valve means for selectively pressurizing manifold line 56 or exhausting the return manifold line 59. A flow restrictor 55 associated with the supply tank 50*b* provides a source of low pressure air (at approximately 1 psi) to the interior of a transducer 58. The transducer 58 includes a diaphragm 58*a* which carries a plunger, indicated generally at 58*b*, for operating the four way valve 54. The low pressure air from line 60 is not only made available to the transducer 58 but also is adapted to provide a continuous source of air at a predetermined depth d below the level of the water 62 behind the dam upon which the bladders A, B, C and associated panels are mounted.

As the water level 62 behind the dam increases in height, and as the depth d of the lower end of the standpipe 60*a* is increased as a result of this water level 62 rising, increased back pressure provides an increase in pressure within the chamber defined by the transducer 58 causing the four way valve to shift in such a way as to exhaust the air pressure in the bladders A, B and C through the return manifold 59. On the other hand should the water level 62 drop below the predetermined depth d the low pressure air will bubble more freely through the stand pipe 60*a* reducing the pressure in the transducer 58 and shifting the four way valve so as to inflate the bladders A, B and C through inflation line 56.

It is an important feature of the present invention that when any individual bladder fails for any reason, and when the bladders A, B and C are inflated at least to some extent, that the bladders and their associated panels will not immediately drop downwardly due to the operation of check valves 72 and 74.

The most significant feature of the control system is that no external power source is required for its operation. A predetermined water level behind the dam can be maintained for a time, and even after the stored air pressure in tank 50*b* is depleted. Air from the air bladders themselves is available to block the deflation line 58 from venting through valve means 54 when the water level is below a specific level and to maintain the existing panel positions, or to vent the deflation line when the water level is higher than that specified limit.

Upon failure of one or more (but not all) of the bladders A, B and C, air pressure from the remaining bladders is available through safety line 64 and flow restrictor 55 to provide low pressure air to the submerged bubbler pipe 60*a* and associated transducer 58, assuring that the valve means 54 is operated as described previously.

In a hydroelectric dam, AC power may be lost and the water level will tend to rise when the flow of water through the hydroelectric turbines is interrupted. The Crest Gate System described herein will continue to operate without any back-up generators or the like. A specified water level will be maintained in such a situation even after the stored air pressure in receiver tank 50*b* has been depleted. Trapped air in the bladders is provided through safety line 64 and flow restrictor 55 for operating transducer 58 and valve 54 to vent or not vent deflation line 59.

Figure 5:
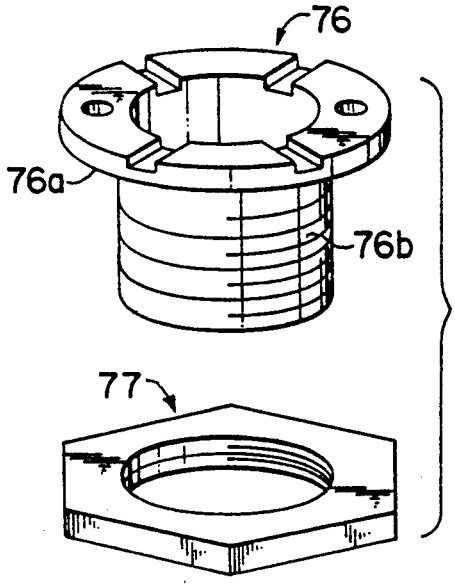
FIG. 5 is a perspective exploded view of an inflation fitting provided in each bladder.

Turning next to FIG. 2, the bladder 44 represents any one of the bladders A, B or C referred to previously with reference to FIG. 1. Each such bladder 44 has a line 70 provided for inflating or deflating the bladder and this line includes a segment extending longitudinally and parallel to the hinge line of the panel 20 as well as a short segment 71*a* passing through a shallow trench 75 provided for this purpose in the dam spillway. This short segment 71*a* is connected to the bladder 44 by a fitting 76, best shown in FIG. 5. The fitting 76 includes a fixed flange portion 76*a* which is radially grooved to provide air under pressure to the bladder even when the bladder is completely compressed. This fitting 76 also has a boss 76*b* that passes through an opening in the trench cover 10*b*, which cover is provided to close the top of the trench 75. The trench cover 10*b* has an upper surface that is oriented in the same plane as the upper surface 10*a* of the concrete spillway A threaded flange nut 77 is provided to secure the fitting 76 to the bladder as best shown in FIGS. 2 and 5.

Figure 3A:
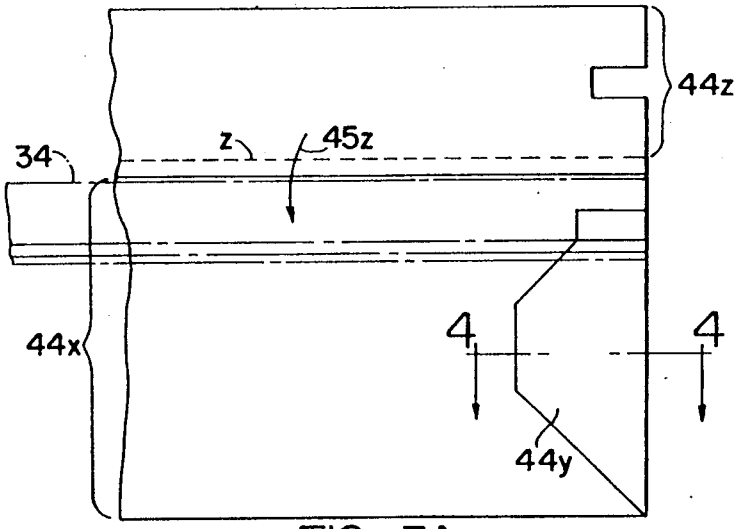
FIG. 3A and 3B are views of the bladder as it is sequentially folded up and also illustrate the location for the clamping bar provided for securing the bladder to the dam spillway.
Figure 3B:
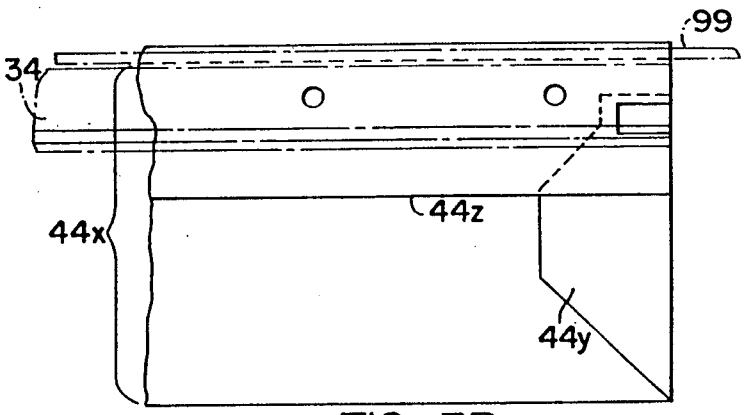
Figure 3:
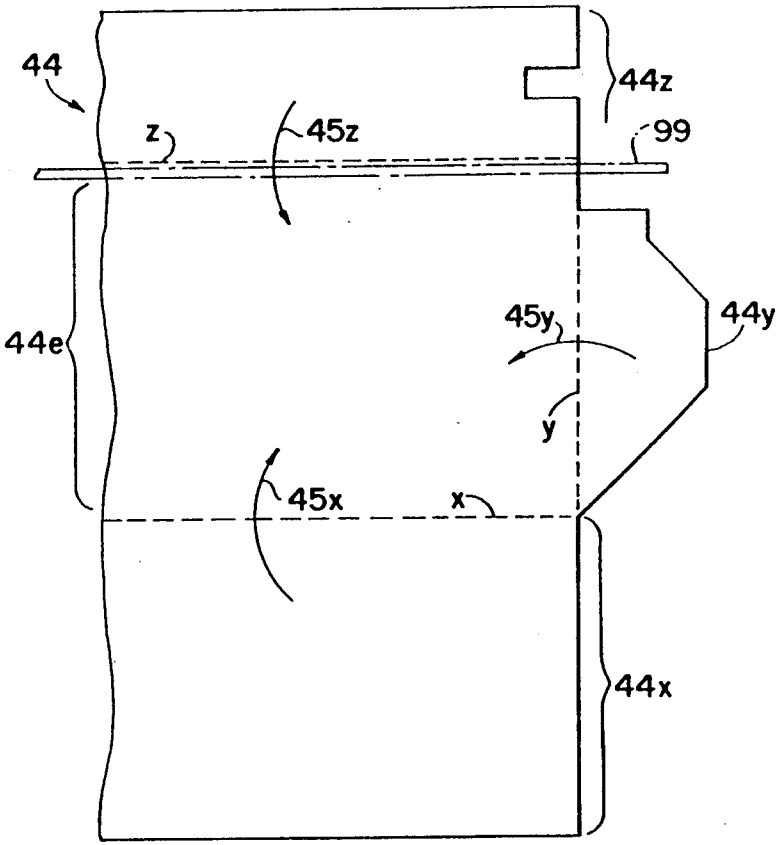
FIG. 3 is a view of one end portion of the bladder sheet after being cut to the desired configuration to form one of the tubular ends, and prior to being folded up and vulcanized or otherwise bonded. An elongated element is shown laid in place prior to the folding steps as indicated generally by the arrows.
Figure 4:
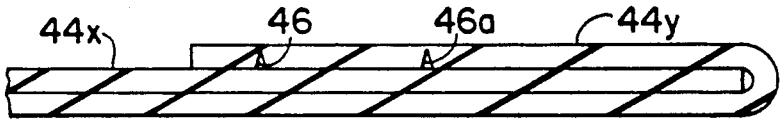
FIG. 4 is a sectional view taken on the line 4—4 of FIG. 3A.

Turning now to a more detailed description of the geometry of the individual bladders, FIG. 3 shows one end portion of a blank from which a typical bladder is made. The other end portion would be generally symmetrical with respect to the end portion shown in FIG. 3. The bladder is preferably fabricated from an elastomeric sheet that may include reinforcing strands and the elastomeric sheet is preferably of synthetic or natural rubber so as to be readily vulcanized to form a sealed joint. The bladder blank 44 shown in FIG. 3 is preferably cut from a sheet of elastomeric material into the shape shown. An elongated rope element 99 is placed across the sheet as shown, and portion 44*x* is folded on the line indicated generally at x in the direction of the arrow indicated generally at 45*x* after which the end portion 44*y* is folded in the direction of the arrow 45*y*. The result of this two step folding operation, indicated generally by the arrows 45*x* and 45*y*, is shown in FIG. 3A. The portion 44*x* lies over central portion 44*e* and under the portion 44*y*. The overlapped portions 44*x* and 44*y* are preferably vulcanized as suggested in FIG. 4. To reduce bond stresses in this vulcanized joining process undercuts are provided in the end portion 44*y* as suggested generally in FIG. 4 at 46, 46*a*. Finally, the oppositely disposed free edge or flap portion 44*z* is folded in the direction of the arrow 45*z* and generally along the line z provided adjacent the elongated element 99. This method of fabrication for the bladder 41 provides for the free flap portion 44*z* of the elastomeric sheet to extend beyond the clamp bar 34 where it is available for securing to the panel 20 by means of the strap 42 referred to previously With reference to FIG. 2. Thus, the same elastomeric sheet not only defines the bladder, but also defines the hinge joint for the panel 20.

In still further accordance with the present invention means is provided for restraining the panels in a limit "up" position ( as shown in FIG. 2) and preferably said means comprises longitudinally spaced abutment stops 35 welded to the clamp bar 34 and adapted for engagement by the gate panel, and as shown by the metal strap 42 provided on the panel 20 and joining the panel to the flap portion 44*g* of the elastomeric sheet.

In an alternative version of restraint for the panel 20 an elongated flexible element may be provided between the upper edge of the panel (not shown) and the upper surface of the concrete spillway 10*a* (as for example by an eye-bolt embedded in the concrete). Such a flexible element may comprise a chain or other restraint as would serve the same purpose as the abutment stops 35 referred to previously, namely to prevent the panel 20 from moving upwardly beyond the position shown for it in FIG. 2. However, the stops 35, 35 are the preferred form for such restraint.

As mentioned previously elastomeric strips may be provided between adjacent panels to prevent excess water from escaping through the openings created between adjacent panels in a typical crest gate installation on a dam spillway. These flexible elastomeric members may themselves comprise the elongated flexible elements referred to in the preceding paragraph for limiting the "up" position of the panel 20. In fact, such flexible elements may be vulcanized to or form extensions of the flap portion 44*g* of the elastomeric bladder sheet itself.

I claim:

1. The combination comprising:

at least one generally rectangular panel having parallel first and second marginal edges, means for supporting said panel for pivotal movement on said first marginal edge, said first marginal edge being oriented generally horizontally at the crest of a dam spillway, at least one inflatable bladder provided downstream of said panel and between the dam spillway and said panel, means for securing said inflatable bladder to said panel supporting means, and means for inflating said bladder, including;

a source of air under pressure, inflation and deflation lines, control valve means for selectively connecting said inflation and deflation lines to said bladder, means for venting air at low pressure at a predetermined point in the water upstream of said panel such that the back pressure exerted on said low pressure air by the water varies in proportion to the water's depth at said predetermined point, transducer means for operating said control valve means in response to air pressure changes resulting from said back pressure effect on said low pressure air.

2. The combination of claim 1 wherein said bladder comprises an elongated elastomeric sheet having one and another marginal edge portions laid one above the other, and sealed joint provided longitudinally of said marginal edge portions, said bladder having integrally formed end portions that include overlapped segments that are sealed to one another, said bladder defining a generally tubular shape when inflated, and said means for securing said bladder comprises a clamping bar overlying said marginal edge portions, and means securing said bar and edge portions to the dam spillway.

3. The combination of claim 2 wherein said longitudinally extending marginal edge portions of said elastomeric bladder have at least one of said edge portions folded back on top of the other edge portion, and a free flap segment of said folded back edge portion, an elongated metal strap secured to said panel with said flap segment therebetween so that said flap segment defines a hinge joint and the means for supporting the panel for pivotal movement.

4. The combination of claim 3 wherein said strap is parallel to said clamping bar and spaced slightly from said bar, said bar having longitudinally spaced abutment stops provided for engagement by said strap when said panel is pivoted upwardly to a predetermined "up" limit position.

5. The combination of claim 2 wherein said inflation and deflation lines, said control valve means and said air pressure source are all located remotely from said bladder and panel and a single individual bladder air line connected to each said bladder, said bladder air line communicating with said inflation line through a first one wa check valve and With said deflation line through a second one way check valve whereby said bladder can be inflated or deflated through said single air line.

6. The combination of claim 2 wherein said means for venting air at low pressure comprises a safety line tapped into said deflation line, and a flow restrictor in said safety line to provide a predetermined pressure in said safety line as long as a bladder is inflated to a pressure of at least said low pressure, said transducer operating said control valve means and the air pressure available to said bladder.

7. The combination of claim 5 wherein said means for venting air at low pressure comprises a safety line tapped into said deflation line, and a flow restrictor in said safety line to provide a predetermined pressure in said safety line as long as said bladder is inflated to a pressure of at least said low pressure, said transducer operating said control valve means and the air pressure available to said bladder.

8. The combination of claim 4 wherein said means for venting air at low pressure comprises a safety line tapped into said deflation line, and a flow restrictor in said safety line to provide a predetermined pressure in said safety line as long as a bladder is inflated to a pressure of at least said low pressure, said transducer operating said control valve means and the air pressure available to said bladder.

9. The combination of claim 3 wherein said means for venting air at low pressure comprises a safety line tapped into said deflation line, and a flow restrictor in said safety line to provide a predetermined pressure in said safety line as long as a bladder is inflated to a pressure of at least said low pressure, said transducer operating said control valve means and the air pressure available to said bladder.

10. The combination of claim 5 wherein said means for venting air at low pressure comprises a safety line tapped into said deflation line, and a flow restrictor in said safety line to provide a predetermined pressure in said safety line as long as said bladder is inflated to a pressure of at least said low pressure, said transducer operating said control valve means and the air pressure available to said bladder.

11. The combination of claim 5 wherein said means for venting air at low pressure comprises a safety line tapped into said deflation line, and a flow restrictor in said safety line to provide a predetermined pressure in said safety line as long as said bladder is inflated to a pressure of at least said low pressure, said transducer operating said control valve means and the air pressure available to said bladder.

12. The combination of claim 5 further characterized by a bladder connection fitting secured in an opening of said bladder, said fitting being annular in shape with a central bore to achieve communication between said bladder and said bladder air line, said fitting having closely spaced annular flanges defining a radially outwardly open slot for receiving said bladder, said bladder air line provided in the dam spillway and coupling means connecting said air line to said bladder fitting, said coupling means provided in a trench defined by said dam spillway, and a cover for said trench and defining an opening for receiving said annular bladder fitting.

13. The combination of claim 12 wherein said bladder connection fitting is fabricated in two parts, one part defining one said annular flange and a threaded boss formed integrally with said annular flange, and a threaded nut received on said boss, said last mentioned flange being adjustably movable toward and away from said first mentioned annular flange.

14. The combination comprising at least one rectangular panel of relatively rigid geometry and having a first marginal and a second marginal edge, elongated inflatable bladder means including at least one elastomeric sheet having one and another marginal edge portion, said one marginal edge portion being laid above said another marginal edge portion, and said another marginal edge portion folded back on top of said one marginal edge portion and defining a marginal edge flap, means securing said flap of said elastomeric sheet to said panel adjacent said first marginal edge of the panel to provide a pivotal hinge joint for said panel relative to said bladder, means for clamping said folded back portion and said marginal edge portions of said elastomeric sheet to a dam spillway or the like and to provide an elongated seal joint longitudinally of the bladder, and means for sealing the elastomeric sheet at its longitudinally opposed ends so that the bladder can be inflated in order to raise the panel pivotally to define a panel up position, and means for restricting pivotal movement of the panel in said raised position.

15. The combination according to claim 14 further characterized by a generally cylindrically elongated rope element provided in association with the fold of said folded back portion of said elastomeric sheet, said cylindrically elongated element being provided adjacent but outside of said clamping means, said clamping means comprising a clamping bar secured to the dam by anchor bolts or the like.

16. The combination according to claim 15 further characterized by raised stops provided on said clamp bar, said panel being adapted to engage said abutment stops on said clamp bar and defining said means for restricting pivotal movement of the panel in its raised position.

17. The method of assembling a crest gate on a dam spillway comprising the steps of:

a) forming a generally flat rectangular blank from elastomeric sheet material such that first and second elongated panels are integrally connected to a central panel along parallel fold lines (x+z), and with end flaps integrally connected to the opposed ends of the central panel along parallel fold lines (y, y) plus the fold lines (x+y), b) laying an elongated element along the fold line (z), between the central panel and the first elongated panel, c) folding the second elongated panel onto the central panel so that the marginal edge of the second panel lays adjacent to the elongated element, d) folding the end flaps of the central panel on their respective fold lines and so that these end flaps overlie end portions second elongated panel, e) bonding the end flaps and the end portions of the second elongated panel, f) providing a clamp bar alongside the elongated element and on top of the marginal edge of the second panel, and securing the clamp bar thru the folded central panel and second panel to a concrete dam spillway or the like, g) securing a rigid gate panel to the first elongated panel of the elastomeric sheet or blank to form a hinged joint between the rigid gate panel and the elastomeric sheet, and h) providing air under pressure to the space defined between the central and second elastomeric sheet panels, such that the gate panel is pivoted upwardly by the bladder action of these elastomeric sheet panels.

18. The method according to claim 17 further characterized by additional step of providing a rubber based elastomeric sheet, and cutting the underside of the end flaps prior to folding them over the central panel end portions in order to prevent deformation of these end flaps upon inflation of the bladder formed by the central panel and the second panel of elastomeric/rubber material.

19. The method according to claim 17 wherein said bonding step is accomplished by vulcanizing the elastomeric/rubber material.

20. The method according to claim 17 wherein said bonding step is accomplished by vulcanizing the elastomeric/rubber material.

* * * * *